US007576703B1

(12) United States Patent
Herting et al.

(10) Patent No.: US 7,576,703 B1
(45) Date of Patent: Aug. 18, 2009

(54) PARALLEL WAVEGUIDE SLOT COUPLER WITH REACTIVE BUFFERING REGION

(75) Inventors: Brian J. Herting, Marion, IA (US); Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 606 days.

(21) Appl. No.: 11/410,582

(22) Filed: Apr. 25, 2006

(51) Int. Cl.
*H01Q 13/10* (2006.01)

(52) U.S. Cl. ..... 343/771; 343/778

(58) Field of Classification Search ..... 343/770, 343/711, 776, 778; 333/239
See application file for complete search history.

(56) References Cited

U.S. PATENT DOCUMENTS 3,701,162 A * 10/1972 Seaton ..... 343/771
4,429,313 A * 1/1984 Muhs et al. ..... 343/771

* cited by examiner

*Primary Examiner*—Michael C Wimer
(74) *Attorney, Agent, or Firm*—Daniel M. Barbieri

(57) ABSTRACT

The present invention is a frequency scanned waveguide antenna including a plurality of radiating waveguides configured as a flat plate array, each radiating waveguide including an enclosure having a front wall and a back wall opposite the front wall, the front wall including a slot configured for radiating and receiving an electromagnetic signal. The antenna further includes a sinuous feed waveguide coupled to each waveguide included in the plurality of radiating waveguides via a slot coupling mechanism, the sinuous feed waveguide including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides. The antenna further includes a reactive buffering region coupled between the flat plate array and the front wall of the sinuous feed waveguide. The sinuous feed waveguide and the plurality of radiating waveguides are oriented as parallel waveguides.

18 Claims, 3 Drawing Sheets

PARALLEL WAVEGUIDE SLOT COUPLER WITH REACTIVE BUFFERING REGION

FIELD OF THE INVENTION

The present invention relates to the field of RF (radio frequency) circuits and components and particularly to a parallel waveguide slot coupler with a reactive buffering region for use in low profile frequency scanned antenna applications such as weather radar.

BACKGROUND OF THE INVENTION

Frequency scanned waveguide antennas have a variety of applications, such as scanning a weather radar antenna pattern in elevation. Frequency scanned waveguide antennas include frequency scanned waveguide antenna feeds, typically traveling wave sinuous feeds, for feeding a signal to an array of radiating waveguides. Sinuous feeds having E-plane (Electric field plane, narrow plane) bends are most commonly implemented due to their commercial availability and their ability to easily achieve low VSWR (Voltage Standing Wave Ratio) levels. However, sinuous feeds having E-plane bends are not low profile. Consequently, frequency scanned waveguide antennas having sinuous feeds with E-plane bends are not ideal for low profile applications such as weather radar. Low profile frequency scanned antenna applications can be addressed using sinuous feeds with H-plane bends. However, a sinuous H-plane bend topology requires parallel waveguide coupling, which exhibits a highly unstable phase response when using standard slot couplers. Standard slot couplers, e.g. tilted slots, work very well for coupling between orthogonal waveguides, but they exhibit high sensitivity to mechanical tolerances when used with parallel waveguides, rendering them unusable in a low cost manufacturing environment.

Therefore, it may be desirable to have a system for electronically scanning a weather radar antenna pattern in elevation which addresses the above-referenced problems and limitations of the current solutions.

SUMMARY OF THE INVENTION

Accordingly, an embodiment of the present invention is directed to a frequency scanned waveguide antenna, including: a plurality of radiating waveguides configured as a flat plate array, each radiating waveguide including an enclosure having a front wall and a back wall opposite the front wall, the front wall including a slot configured for radiating and receiving an electromagnetic signal; a sinuous feed waveguide coupled to each waveguide included in the plurality of radiating waveguides via a slot coupling mechanism, the sinuous feed waveguide including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides; and a reactive buffering region coupled between flat plate array and the front wall of the sinuous feed waveguide, wherein the sinuous feed waveguide and the plurality of radiating waveguides are oriented as parallel waveguides.

A further embodiment of the present invention is directed to a frequency scanned waveguide antenna, including: a plurality of radiating waveguides configured as a flat plate array, each radiating waveguide including an enclosure having a front wall and a back wall opposite the front wall, the front wall including a slot configured for radiating and receiving an electromagnetic signal; a sinuous feed waveguide coupled to each waveguide included in the plurality of radiating waveguides via a slot coupling mechanism, the sinuous feed waveguide having a plurality of H-plane bends and including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides; and a reactive buffering region coupled between flat plate array and the front wall of the sinuous feed waveguide, the reactive buffering region being an electrically short sheet of metal including an aperture through which a signal may be passed from the sinuous feed waveguide to a radiating waveguide included in the plurality of radiating waveguides, wherein the sinuous feed waveguide and the plurality of radiating waveguides are oriented as parallel waveguides.

An additional embodiment of the present invention is directed to a reactive buffering region for use in broad wall coupling of parallel waveguides, including: an electrically short sheet of metal including an aperture configured for allowing passage of a signal from a first parallel waveguide to a second parallel waveguide, wherein the reactive buffering region provides stable phase operation over a range of frequencies and further provides stability with respect to mechanical tolerances in a slot coupling mechanism of the parallel waveguides.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
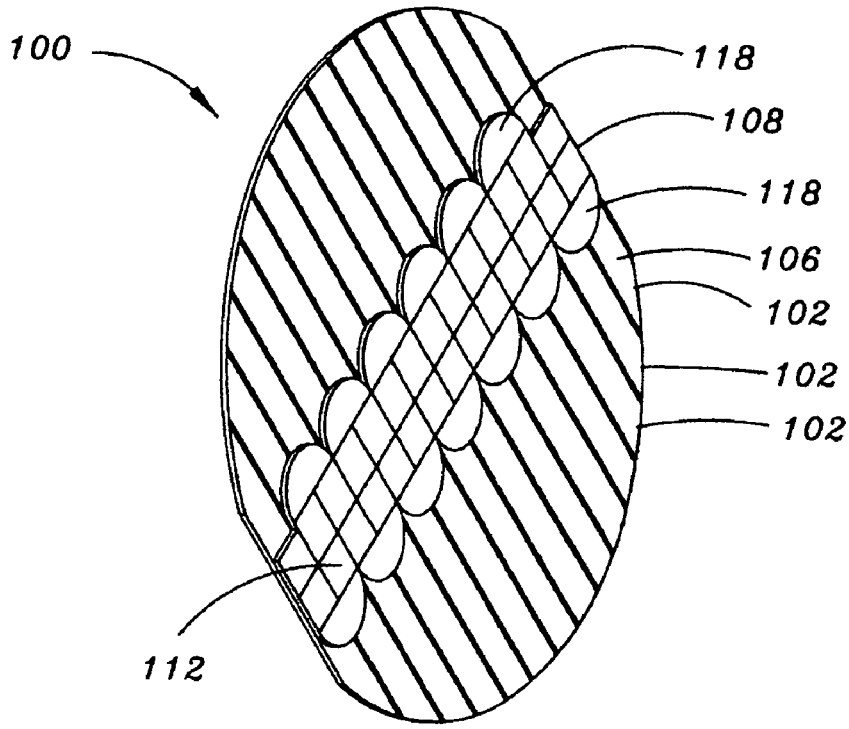
FIG. 1 is an isometric view of a frequency scanned waveguide antenna in accordance with an exemplary embodiment of the present invention.

Referring generally to FIGS. 1-5, exemplary embodiments of the present invention are shown. In a present embodiment, a frequency scanned waveguide antenna 100 includes a plurality of radiating waveguides 102 configured as a flat plate array (as shown in FIG. 1). Each radiating waveguide 102 forms an enclosure having a front wall 104 and a back wall 106 opposite the front wall 104. In an exemplary embodiment, the front wall 104 of each radiating waveguide 102 forms at least one slot (not shown) configured for radiating and receiving an electromagnetic signal.

In a current embodiment, the frequency scanned waveguide antenna 100 includes a sinuous feed waveguide 108. The sinuous feed waveguide 108 is coupled to each waveguide included in the plurality of radiating waveguides 102 via a slot coupling mechanism. The sinuous feed waveguide 108 forms an enclosure having a front wall 110 and a back wall 112 opposite the front wall 110. In a present embodiment, the front wall 110 of the sinuous feed waveguide 108 is oriented towards the back walls 106 of the plurality of radiating waveguides 102. Further, the front wall 110 of the sinuous feed waveguide 108 forms a plurality of slot couplers 114. In the exemplary embodiment, the slot couplers 114 are each configured for feeding an electromagnetic signal to the plurality of radiating waveguides 102 via a plurality of corresponding feed slots 116 formed by the back walls 106 of the plurality of radiating waveguides 102. In the illustrated embodiments, the sinuous feed waveguide 108 includes H-plane (i.e., magnetic field plane/wide plane) bends 118. The H-plane bends 118 allow the sinuous feed waveguide 108 to be a low profile sinuous feed waveguide relative to current sinuous feed waveguides, which utilize E-plane (i.e., electric field plane/narrow plane) bends. For example, the sinuous feed waveguide 108, due to its H-plane bend construction, is configured to conform to the back side of the flat plate array of radiating waveguides 102, in a low profile manner (as shown in FIG. 1). In the present embodiment, the sinuous feed waveguide 108 and the plurality of radiating waveguides 102 are oriented as parallel waveguides.

Figure 2:
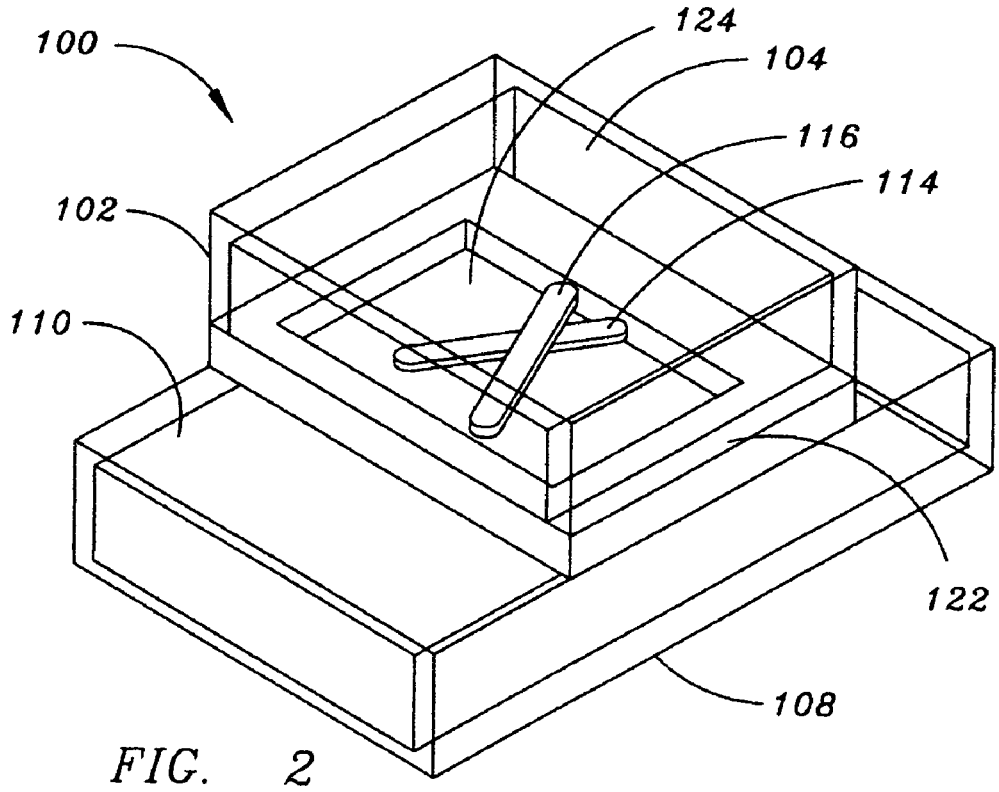
FIG. 2 is a sectional view of a frequency scanned waveguide antenna in accordance with an exemplary embodiment of the present invention.
Figure 3:
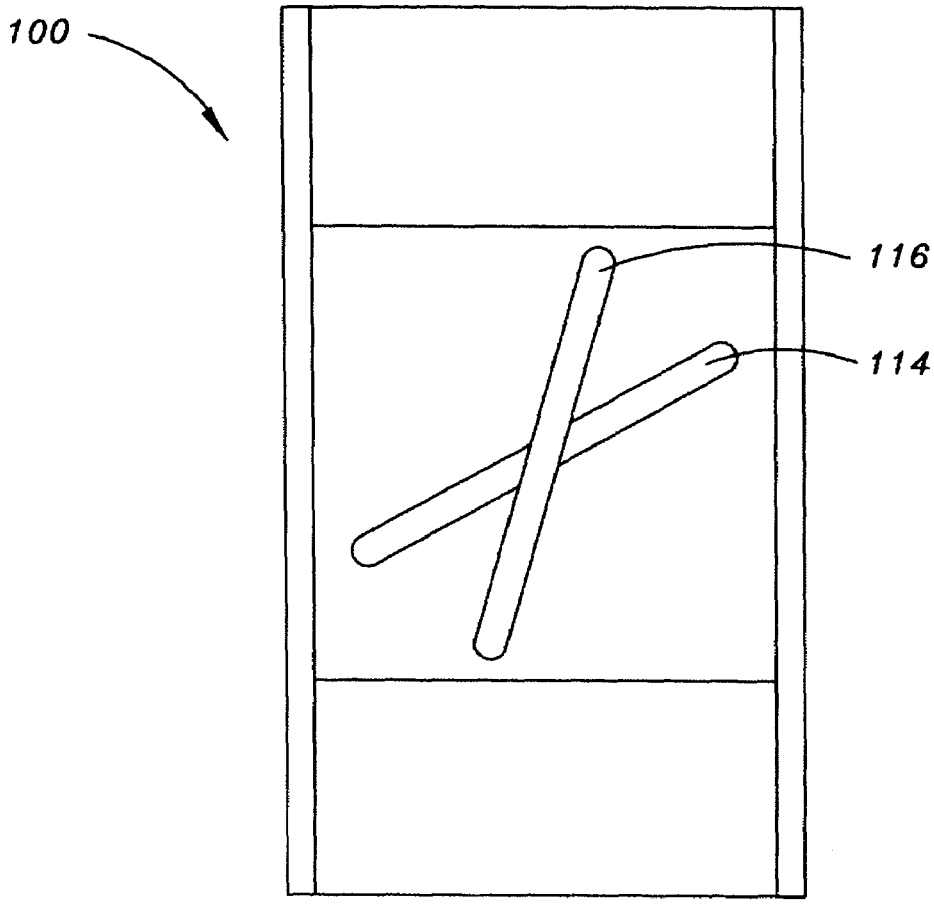
FIG. 3 is an elevated sectional view of a frequency scanned waveguide antenna in accordance with an exemplary embodiment of the present invention.
Figure 4:
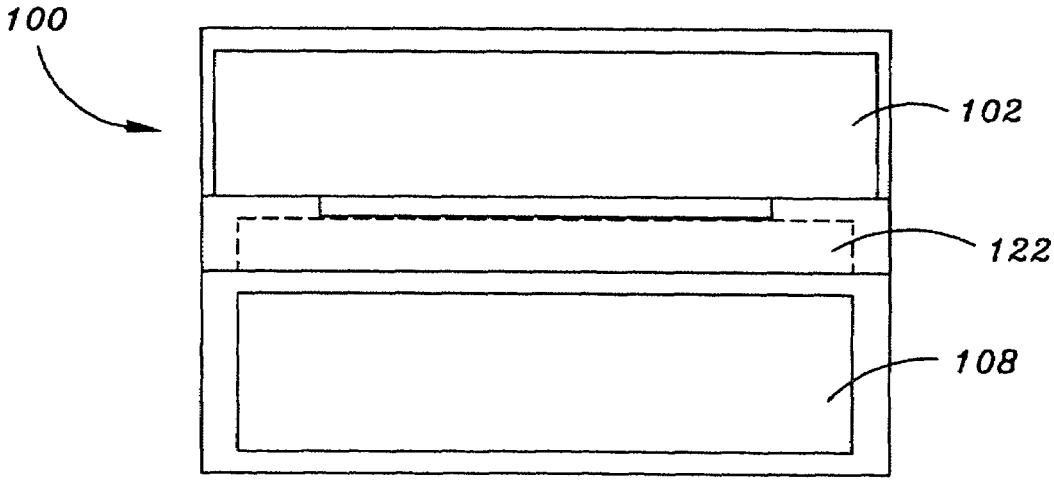
FIG. 4 is a sectional end view of a frequency scanned waveguide antenna in accordance with an exemplary embodiment of the present invention.
Figure 5:
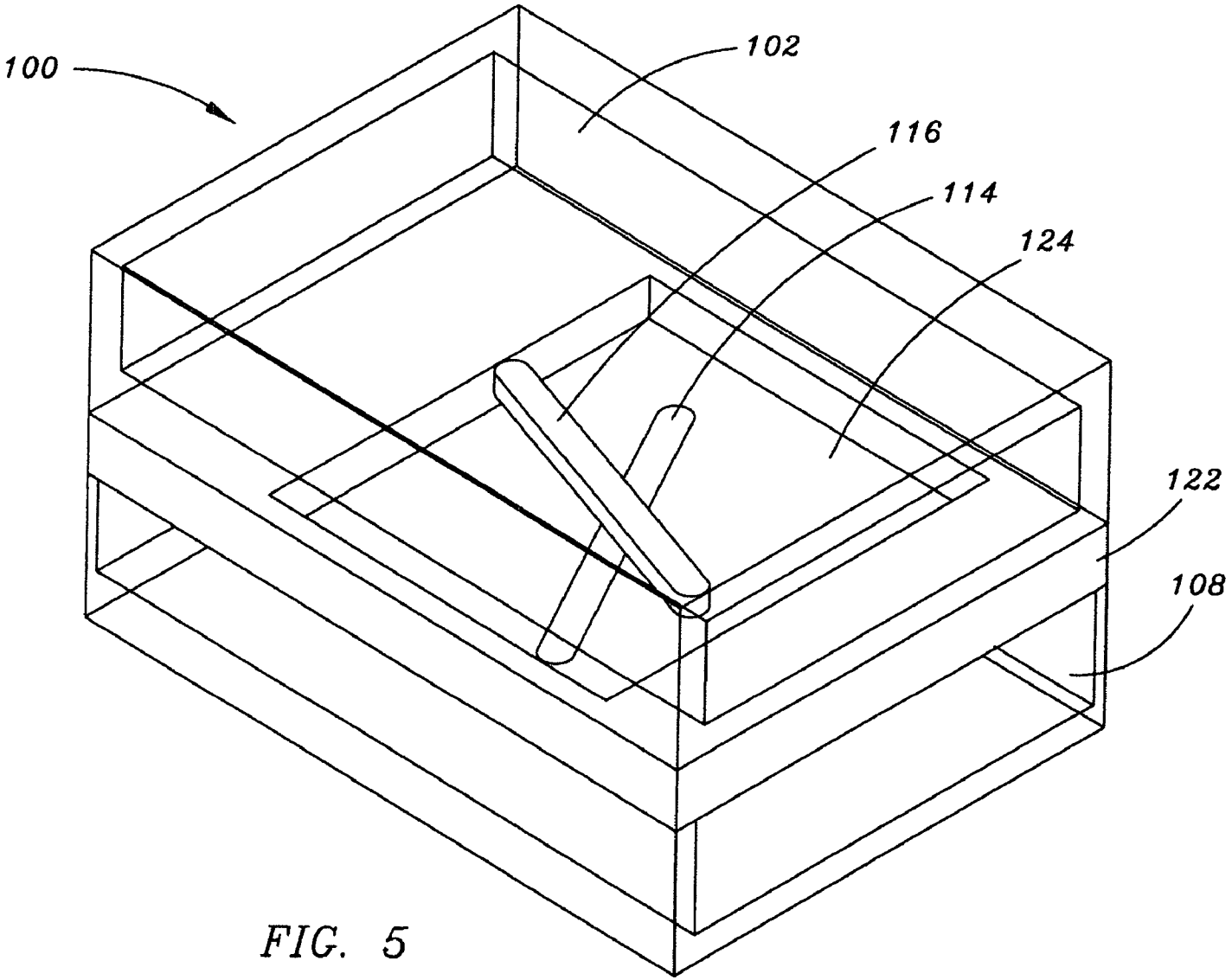
FIG. 5 is a sectional view of a frequency scanned waveguide antenna in accordance with an exemplary embodiment of the present invention.

In an exemplary embodiment, the frequency scanned waveguide antenna 100 further includes a reactive buffering region 122 coupled between the flat plate array (i.e., the plurality of radiating waveguides 102) and the front wall 110 of the sinuous feed waveguide 108. In further embodiments, the reactive buffering region 122 may be used for broad wall coupling of various types of parallel waveguides. In current embodiments, the reactive buffering region 122 is an electrically short region which allows voltage/current to be effectively constant over its extent. For instance, the reactive buffering region 122 may be a sheet of metal including an aperture 124 through which an electromagnetic signal may be passed when being transmitted between the sinuous feed waveguide 108 and a radiating waveguide 102 included in the plurality of radiating waveguides 102. The reactive buffering region 122 allows the parallel waveguide slot coupling mechanism, which includes the back wall feed slot 116 of a radiating waveguide 102, the aperture 124 of the reactive buffering region 122 and the front wall slot coupler 114 of the sinuous feed waveguide 108, to be resonant (i.e., maintain resonance). Resonance is the tendency of a system to absorb more energy when the frequency of its oscillations matches the system's natural frequency of vibration (its resonant frequency) than it does at other frequencies. By being resonant, or maintaining resonance, a system, such as the frequency scanned antenna 100 of the present invention, operates more efficiently. Further, the reactive buffering region 122 allows the resonance of the slot coupling mechanism to be desensitized to its mechanical tolerances. For example, resonance of the frequency scanned antenna 100 may be desensitized to changes in the dimensions of an element included in the slot coupling mechanism, or as shown in FIGS. 2, 3 and 5, changes in the relative orientation/alignment of the slot coupling mechanism elements, such as offsetting a back wall feed slot 116 of a radiating waveguide 102 from a slot coupler 114 of the sinuous feed waveguide 108. Further, the frequency scanned antenna 100 of the present invention may be able to maintain resonance over a greater range of scanned operating frequencies than previous systems. For a frequency scanned antenna being implemented in radar (radio detection and ranging) applications, this may result in a more stable phase response with frequency scanning. By desensitizing resonance of the frequency scanned antenna 100 to changes in the dimensions or the in the orientation/alignment of the slot coupling mechanism elements, the reactive buffering region provides for additional degrees of freedom when designing waveguide slot coupling mechanisms.

In an exemplary embodiment, the frequency scanned waveguide antenna 100 is a weather radar antenna configured for electronically scanning a weather radar antenna pattern in elevation (i.e., at angles ranging from 0 to 90 degrees above and 0 to −90 degrees below horizon). The amount of electrical beam scan achieved depends on the frequency bandwidth and total length of waveguide from one slot coupler 114 of the sinuous feed waveguide 108 to the next slot coupler 114 of the sinuous feed waveguide 108.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A frequency scanned waveguide antenna, comprising:

a plurality of radiating waveguides configured as a flat plate array, each radiating waveguide including an enclosure having a front wall and a back wall opposite the front wall, the front wall including a slot configured for radiating and receiving an electromagnetic signal;

a sinuous feed waveguide coupled to each waveguide included in the plurality of radiating waveguides via a slot coupling mechanism, the sinuous feed waveguide including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides; and a reactive buffering region coupled between the flat plate array and the front wall of the sinuous feed waveguide, wherein the sinuous feed waveguide and the plurality of radiating waveguides are oriented as parallel waveguides.

2. A frequency scanned waveguide antenna as claimed in claim 1, wherein the sinuous feed waveguide includes H-plane bends.

3. A frequency scanned waveguide antenna as claimed in claim 1, wherein the reactive buffering region is an electrically short region.

4. A frequency scanned waveguide antenna as claimed in claim 1, wherein the slot coupling mechanism is resonant.

5. A frequency scanned waveguide antenna as claimed in claim 1, wherein the sinuous feed waveguide is configured to conform to a back side of the flat plate array in a low profile manner.

6. A frequency scanned waveguide antenna as claimed in claim 1, wherein the reactive buffering region is a sheet of metal including an aperture through which a signal may be passed from the sinuous feed waveguide to a radiating waveguide included in the plurality of radiating waveguides.

7. A frequency scanned waveguide antenna as claimed in claim 1, wherein the frequency scanned waveguide antenna is a weather radar antenna.

8. A frequency scanned waveguide antenna as claimed in claim 7, wherein the weather radar antenna is configured for electronically scanning a weather radar antenna pattern in elevation.

9. A frequency scanned waveguide antenna, comprising:

a plurality of radiating waveguides configured as a flat plate array, each radiating waveguide including an enclosure having a front wall and a back wall opposite the front wall, the front wall including a slot configured for radiating and receiving an electromagnetic signal;

a sinuous feed waveguide coupled to each waveguide included in the plurality of radiating waveguides via a slot coupling mechanism, the sinuous feed waveguide having a plurality of H-plane bends and including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides; and a reactive buffering region coupled between the flat plate array and the front wall of the sinuous feed waveguide, the reactive buffering region being an electrically short sheet of metal including an aperture through which a signal may be passed from the sinuous feed waveguide to a radiating waveguide included in the plurality of radiating waveguides, wherein the sinuous feed waveguide and the plurality of radiating waveguides are oriented as parallel waveguides.

10. A frequency scanned waveguide antenna as claimed in claim 9, wherein the slot coupling mechanism is resonant.

11. A frequency scanned waveguide antenna as claimed in claim 9, wherein the sinuous feed waveguide is configured to conform to a back side of the flat plate array in a low profile manner.

12. A frequency scanned waveguide antenna as claimed in claim 11, wherein the frequency scanned waveguide antenna is a weather radar antenna.

13. A frequency scanned waveguide antenna as claimed in claim 12, wherein the weather radar antenna is configured for electronically scanning a weather radar antenna pattern in elevation.

14. A reactive buffering region for use in broad wall coupling of parallel waveguides, comprising:

an electrically short sheet of metal including an aperture configured for allowing passage of a signal from a first parallel waveguide to a second parallel waveguide, the second parallel waveguide being one of a plurality of radiating waveguides, the plurality of radiating waveguides being configured as a flat plate array, each radiating waveguide including an enclosure having a front wall and a back wall opposite the front wall, the front wall including a slot configured for radiating and receiving an electromagnetic signal, the first parallel waveguide being a sinuous feed waveguide, the sinuous feed waveguide being coupled to each waveguide included in the plurality of radiating waveguides via a slot coupling mechanism, the sinuous feed waveguide including an enclosure having a front wall and a back wall opposite the front wall, the front wall of the sinuous feed waveguide being oriented towards the back walls of the plurality of radiating waveguides, the front wall of the sinuous feed waveguide further including a plurality of slot couplers, the slot couplers each configured for feeding an electromagnetic signal to the plurality of radiating waveguides via a plurality of corresponding feed slots formed by the back walls of the plurality of radiating waveguides, wherein the reactive buffering region provides stable phase operation over a range of frequencies and further provides stability with respect to mechanical tolerances in the slot coupling mechanism of the parallel waveguides.

15. A reactive buffering region as claimed in claim 14, wherein the sinuous feed waveguide includes H-plane bends and is configured to conform to a back side of the flat plate array in a low profile manner.

16. A reactive buffering region as claimed in claim 15, wherein the plurality of radiating waveguides, the sinuous feed waveguide and the reactive buffering region are part of a frequency-scanned waveguide antenna.

17. A reactive buffering region as claimed in claim 16, wherein the frequency scanned waveguide antenna is a weather radar antenna.

18. A reactive buffering region as claimed in claim 17, wherein the weather radar antenna is configured for electronically scanning a weather radar antenna pattern in elevation.

* * * * *